US010450680B2

(12) United States Patent
Bunnag et al.

(10) Patent No.: US 10,450,680 B2
(45) Date of Patent: Oct. 22, 2019

(54) MULTI-PURPOSE TOOL FOR MAKING CRAFTS

(71) Applicant: Vilasinee Bunnag, Emeryville, CA (US)

(72) Inventors: Vilasinee Bunnag, Emeryville, CA (US); Rose Pearlman, Brooklyn, NY (US)

(73) Assignee: Loome, LLC, Emeryville, CA (US)

( * ) Notice: Subject to any disclaimer, the term of this patent is extended or adjusted under 35 U.S.C. 154(b) by 0 days.

(21) Appl. No.: 15/739,348

(22) PCT Filed: Jun. 29, 2016

(86) PCT No.: PCT/US2016/040210
§ 371 (c)(1),
(2) Date: Dec. 22, 2017

(87) PCT Pub. No.: WO2017/004273
PCT Pub. Date: Jan. 5, 2017

(65) Prior Publication Data

US 2018/0187350 A1 Jul. 5, 2018

Related U.S. Application Data

(60) Provisional application No. 62/185,945, filed on Jun. 29, 2015.

(51) Int. Cl.
*D04D 11/00* (2006.01)
*D04D 7/08* (2006.01)
(Continued)

(52) U.S. Cl.
CPC ..... *D04D 11/00* (2013.01); *D04D 7/06* (2013.01); *D04D 7/08* (2013.01); *D04D 9/04* (2013.01)

(58) Field of Classification Search
CPC .. D04D 7/02; D04D 7/06; D04D 7/08; D04D 11/00; D04D 7/00; D04D 7/10;
(Continued)

(56) References Cited

U.S. PATENT DOCUMENTS 762,493 A * 6/1904 Ruddy ..... D04B 33/00 28/149
1,078,242 A * 11/1913 Bartholomew ..... D04B 33/00 28/149
(Continued)

FOREIGN PATENT DOCUMENTS

JP 2003147668 A 5/2003

OTHER PUBLICATIONS

International Search Authority/US, International Search Report and Written Opinion issued in corresponding PCT Application No. PCT/US2016/40210, dated Oct. 28, 2016 (12 pages).
(Continued)

*Primary Examiner* — Amy Vanatta
(74) *Attorney, Agent, or Firm* — Wood Herron & Evans, LLP

(57) ABSTRACT

An improved multi-purpose tool useful for creating various crafts using yarn is disclosed. The tool comprises a bottom portion and a top portion. The bottom portion comprises one or more bottom members, the one or more bottom members having a space in between and extending downwards and generally parallel to each other at ends of the one or more bottom members. The upper portion comprises one or more upper members, the one or more upper members having a space in between and extending upwards and generally parallel to each other at ends of the one or more upper members. The tool also includes one or more notches contained in the ends of the one or more bottom members and in the ends of the one or more upper members. The
(Continued)

notches along with the upper and/or bottom portions allow a user to create a variety of crafts using the same tool. The tool may also include one or more holes to help the yarn used for crafting from getting twisted. The bottom and upper portions together form different shapes for the tool such as Y-shape, H-shape, X-shape etc. Additionally, the tool may function as a sling shot.

16 Claims, 8 Drawing Sheets

(51) Int. Cl.
*D04D 7/06* (2006.01)
*D04D 9/04* (2006.01)

(58) Field of Classification Search
CPC . D04D 9/04; D03D 29/00; D04B 3/00; D04B 39/00; D05C 1/02; D06C 3/08; D06C 2700/10; F41B 3/02; F41B 3/03; F41B 3/00
USPC .... 28/147, 149, 151, 152, 150, 145; 223/46; 66/1 A; 124/20.1, 20.2; D22/106
See application file for complete search history.

(56) References Cited

U.S. PATENT DOCUMENTS 1,975,924 A * 10/1934 Collingbourne ..... D03D 29/00 28/151
2,317,914 A * 4/1943 Mcintyre ..... D04D 5/00 223/44
2,322,060 A * 6/1943 Samuels ..... D04D 7/06 28/147
2,580,088 A * 12/1951 Goerdeler ..... B65H 54/68 28/149
D166,403 S * 4/1952 McColl ..... B65H 54/68 124/20.1
2,600,524 A 6/1952 Fernsel
2,715,895 A * 8/1955 Loveless ..... F41B 3/02 124/20.3
2,828,896 A * 4/1958 Hanselman ..... D04D 7/10 223/46
3,287,785 A 11/1966 Ciroli
3,409,029 A * 11/1968 Kumpa ..... A45D 24/04 132/133
3,413,699 A 12/1968 Millay
3,417,761 A * 12/1968 Kulnis ..... A45D 8/14 132/284
3,833,157 A * 9/1974 Lofton ..... A41G 1/02 156/173
3,854,179 A 12/1974 Montoya
3,923,034 A * 12/1975 Wolf ..... F41B 3/02 124/20.1
7,059,314 B1 * 6/2006 Teague ..... F41B 3/02 124/20.3
2007/0028991 A1 2/2007 Cavender
2007/0214842 A1 * 9/2007 Lozar ..... D04D 5/00 66/1 A
2013/0015214 A1 * 1/2013 Ranzau ..... A41D 25/08 223/46

OTHER PUBLICATIONS

Tramontana, A., Pom Pom Maker DIY With Cardboard, www.school-of-scrap.com, 2012 [retrieved by ISA on Sep. 16, 2016]. Retrieved from the internet: <URL:http://www.school-of-scrap.com.2012/pom-pom-maker-fai-da-te-con-l-cartone/>.
European Patent Office, Supplemental Search Report issued in corresponding European Patent Application No. 16818731.8, dated Jul. 5, 2018 (8 pages).

* cited by examiner

MULTI-PURPOSE TOOL FOR MAKING CRAFTS

CROSS-REFERENCE TO RELATED APPLICATIONS

This application is the U.S. National Phase of PCT Application No. PCT/US2016/40210 filed on Jun. 29, 2016 and claims the priority and benefit of U.S. patent application Ser. No. 62/185,945, filed on Jun. 29, 2015, the entire contents of which are incorporated herein by reference.

BACKGROUND

The present invention relates generally to arts and crafts. More particularly, the invention relates to an improved multi-purpose craft-making tool for creating various woven and fiber-based crafts.

Currently in the arts and crafts field, to make various crafts such as pom-poms, tassels, friendship bracelets, various cords and weavings, a person needs to buy different tools or devices to make each of the above mentioned crafts. For example, a pom-pom maker makes pom-poms, and cannot make tassels or friendship bracelets. Further, currently available tools allow a user to make either linked items such as necklace and bracelets or non-linked items such as pom-poms. Available tools also do not provide a good way to keep the fiber untangled while in use. Moreover, some of the current tools or devices have additional and moving parts. Accordingly, there is a need for a multi-purpose tool for creating various crafts in an easy-to-use manner.

SUMMARY OF THE INVENTION

The present invention is an improved multi-purpose craft tool that allows a user to make various woven, non-woven and fiber-based crafts with the same tool. The tool has a lower portion and an upper portion that together form a H, Y, A or other shape. The ends of the tool have one or more ridges that, along with the upper and/or lower portion, allow a fiber or yarn to be secured for making different crafts such as pom-poms, friendship bracelets, tassels etc. or allow setting up of a warp for weaving. The tool has one or more holes through which the yarn or fiber may pass through to keep the yarn or fiber untangled. The tool may also serve as a sling shot.

DETAILED DESCRIPTION OF THE INVENTION

The following detailed description and accompanying drawings disclose various aspects and/or embodiments of the invention. Alternate aspects and/or embodiments may be devised without departing from the scope of the disclosure. Additionally, well-known elements of the disclosure are not described in detail or have been omitted so as not to obscure the relevant details of the disclosure.

The words "exemplary," "e.g.," "such as," and/or "example" are used herein to mean "serving as an example, instance, or illustration. Any aspect or embodiment described herein as "exemplary," "e.g.," "such as," and/or "example" is not necessarily to be construed as preferred or advantageous over other aspects or embodiments. Likewise, the term "aspect/embodiment of the disclosure/invention" does not require that all aspects or embodiments include the discussed feature, advantage or mode of operation. The term "yarn" as used herein refers to and is used interchangeably with yarns, threads, twines and other such materials. The term "notches" and "ridges" are used herein interchangeably.

Figure 1:
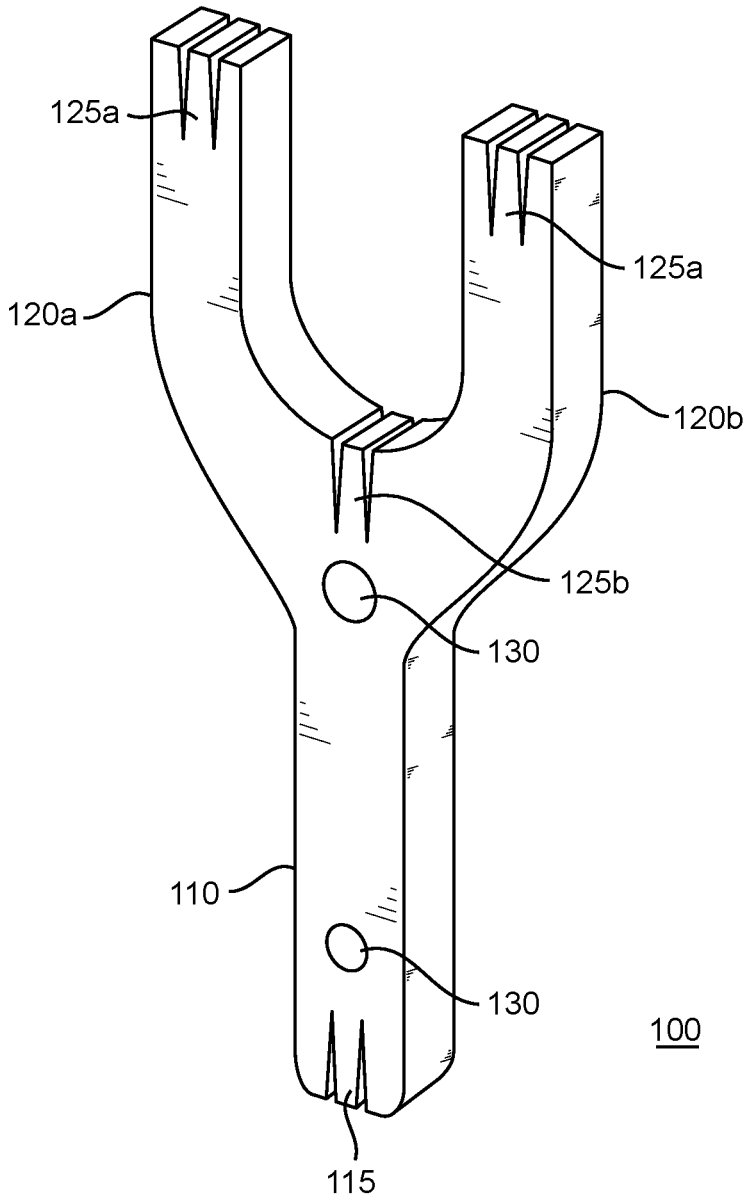
FIG. 1 is a perspective view of a multi-purpose craft tool, in accordance with one embodiment of the invention.

With reference to FIG. 1, an exemplary craft tool 100 in accordance with one embodiment of the invention is disclosed. The tool 100 comprises a lower or bottom portion 110 and an upper portion 120. The bottom portion 110 is straight and the upper portion 120 forms a U-shape. The upper portion 120 has a first upper member 120*a* and a second upper member 120*b* that together form the U-shape. The first and second upper members 120*a* and 120*b* extend upwards from the bottom portion and are generally parallel to each other at the ends of the first and second upper members. Each of the first and second upper members 120*a* and 120*b* has one or more notches or ridges 125*a* at their ends. The base or groove of the U-shape formed by the first and second upper members is rounded and may also have one or more notches 125*b*. The bottom portion 110 also has one or more notches 115 at its end. The bottom and upper portions together form a Y-shaped tool. The bottom portion of the tool also acts as a handle and helps the user to hold the tool with use when in use. The bottom and upper portions of the tool, along with the notches, allow the user to secure, wind or weave. The craft tool may have one or more holes 130 in the bottom portion 110 or in a central or middle part of the tool. The hole may be circular or any other shape.

Figure 2A:
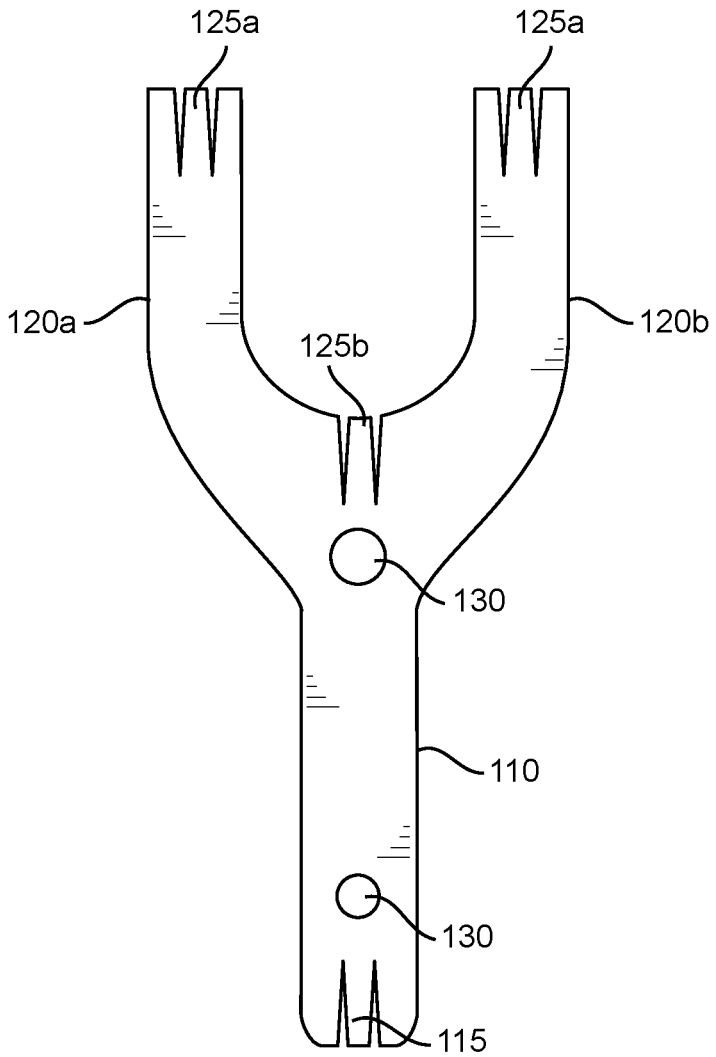
FIG. 2A is a front elevation view of the craft tool of FIG. 1, in accordance with one embodiment of the invention.
Figure 2B:
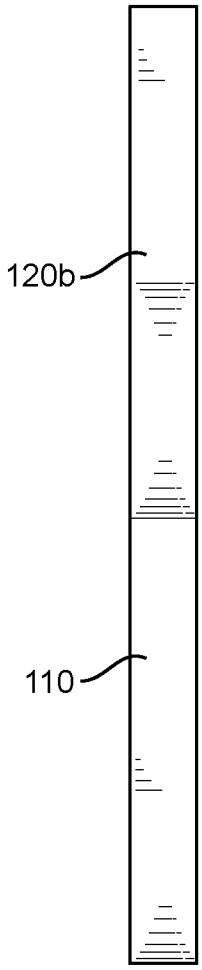
FIG. 2B is a side elevation view of the craft tool of FIG. 1, in accordance with one embodiment of the invention.

The notches 115, 125*a* and 125*b* may be used for securing various threads or yarn to the tool so as to utilize weaving, looming, braiding, and any other such crafting techniques with multiple strands of such threads or yarn. The holes 130 on the bottom portion may be used to complement the notches 115, 125*a* and 125*b* in the crafting process. It also helps the yarn stay in place during any crafting and is particularly helpful for weaving bracelets and cords where several strands of such materials are required, so as to keep them from twisting when they are being woven. FIG. 2A and FIG. 2B respectively show front and side elevation views of the craft tool of FIG. 1.

Figure 3:
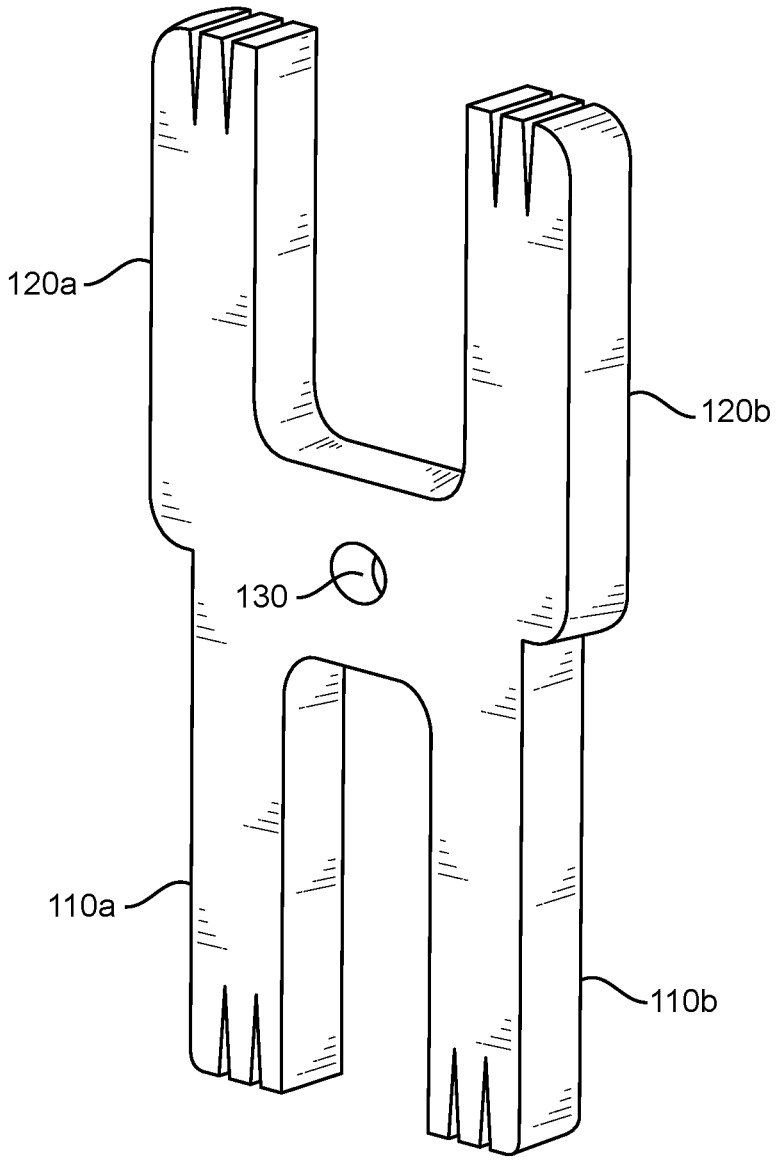
FIG. 3 is a perspective view of a multi-purpose craft tool, in accordance with a second embodiment of the invention.

In another embodiment, the first member 120*a* and the second member 120*b* of the upper portion may form a different shape. Like the upper portion, the bottom portion 110 may have a first bottom member 110*a* and a second bottom member 110*b* that together form an inverted U-shape. The first and second bottom members extend downwards from the upper portion and are generally parallel to each other at the ends of the first and second bottom members. The base or groove of the inverted U-shape formed by the first and second bottom members is flat without any notches. The U-shape of the upper portion may be a square U-shape with a flat groove and larger than the U-shape formed by the bottom portion. This is shown in FIG. 3 and gives the tool an overall H or robot-shape. Further, there may only be one hole 130 in the center of the tool or there may be no hole.

Figure 4:
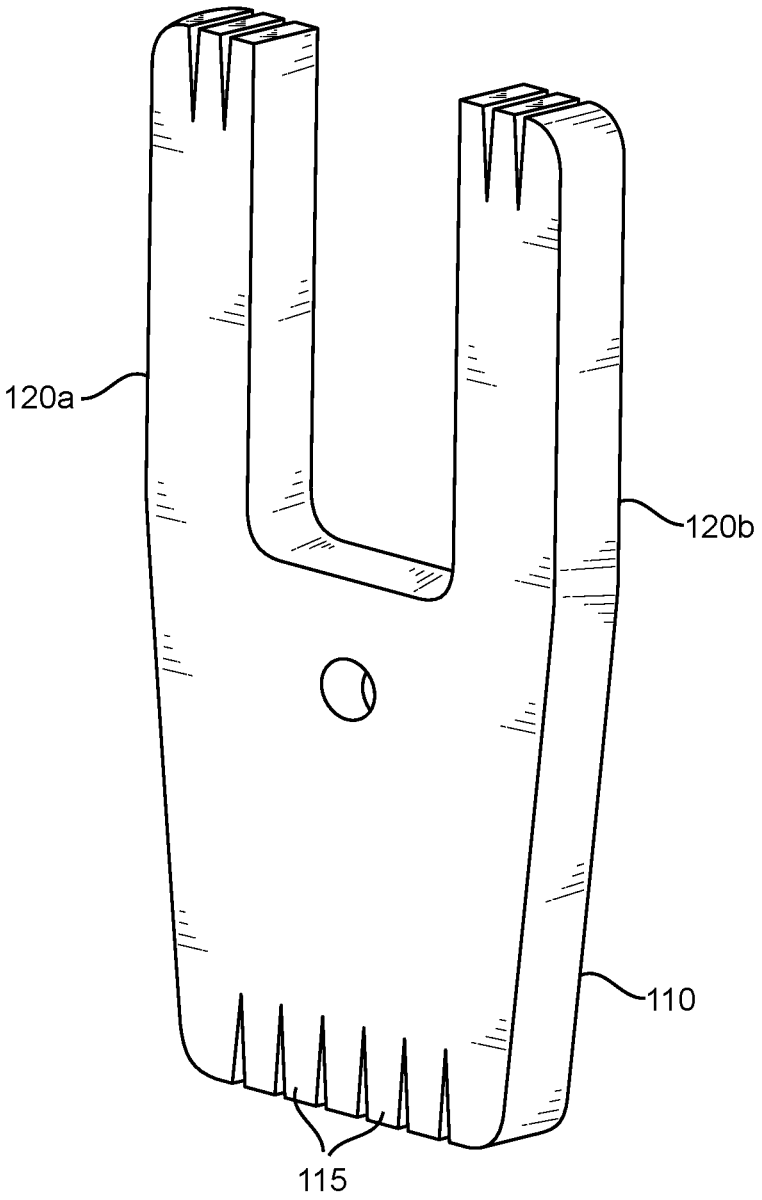
FIG. 4 is a perspective view of a multi-purpose craft tool, in accordance with a third embodiment of the invention.
Figure 5:
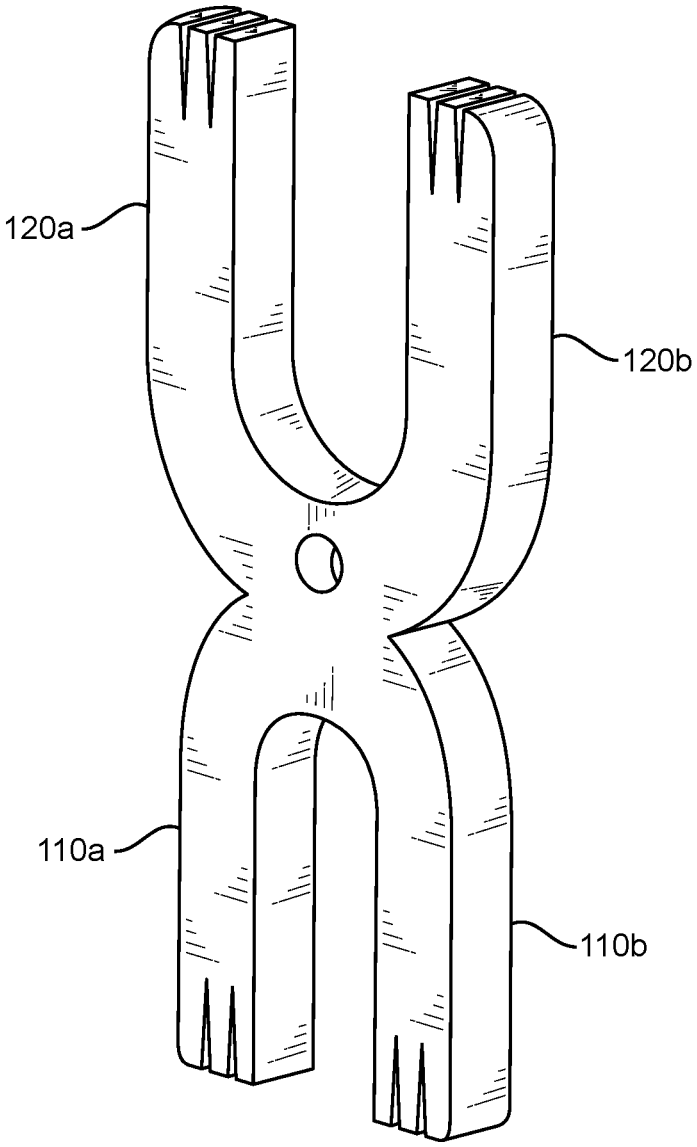
FIG. 5 is a perspective view of a multi-purpose craft tool, in accordance with a fourth embodiment of the invention.

In yet another embodiment shown in FIG. 4, the bottom portion 110 has only one member which is wider than the space between the two upper members. The two upper members of the upper portion form a U-shape such that the tool has an overall inverted A-shape. Alternately, the upper portion 120 may have only one member and be wider than the space between the two bottom members so as to form a regular A-shape for the tool. The ends of the wider bottom portion 110 may have a plurality of notches 115. The base or groove of the U-shape formed by the first and second upper members of the upper portion is flat without any notches. Alternately, it may have one or more notches. In yet another embodiment shown in FIG. 5, the first and second bottom members of the bottom portion 110 form an inverted U-shape with a rounded groove. The first and second upper members of the upper portion 120 form a U-shape with a rounded groove so as form an X or chromosome-shape for the tool.

Other shapes of the upper and/or bottom portion are possible and provide a different overall shape for the tool 100 and the holes and notches may be disposed at different locations along the tool 100 so long as the members, notches and holes function in accordance with the present invention as described herein. For example, the tool may have a V-shape or a rectangular shape etc. The base or groove of the shape formed by the upper portion or the lower portion may be rounded or straight. Further, the bottom portion of the tool may have more than two members extending downwards. The upper portion of the tool may also have more than two members extending upwards. For example, the tool may have three members in the upper portion. The tool may have more or less than one or two holes 130. Alternately, the tool may have no holes. Similarly, the tool may have more or less notches 115 or 125*a* or 125*b*. In some embodiments, there may be no notches 125*b*. The notches may be of any suitable shape such as rounded, tapered, slit, curved, straight, zigzag etc. as long as they can secure the yarn in place. Further, where the tool has more than one notch in the first and second members of the upper or lower portions of the tool, the notches may be equidistant from each other or not. In another alternative embodiment, ruler measurement markings may be disposed along the bottom portion 110 and/or the upper portion 120. The bottom and upper portions of the tool may be of any suitable size. For example, the tool may be about 5.1 inches long and about 2.2 inches wide with a width to length ratio of about 1:2.2. Alternately, the tool may be about 3.2 inches wide and about 7.3 inches long with a width to length ratio of about 1:2.3. The tool may be scaled to any suitable size and the ratio of width to length may be adjusted as needed to ensure the design is in the desired shape and size. The tool may be made of any suitable, durable and resilient material such as wood, plastic, metal etc.

Figure 6B:
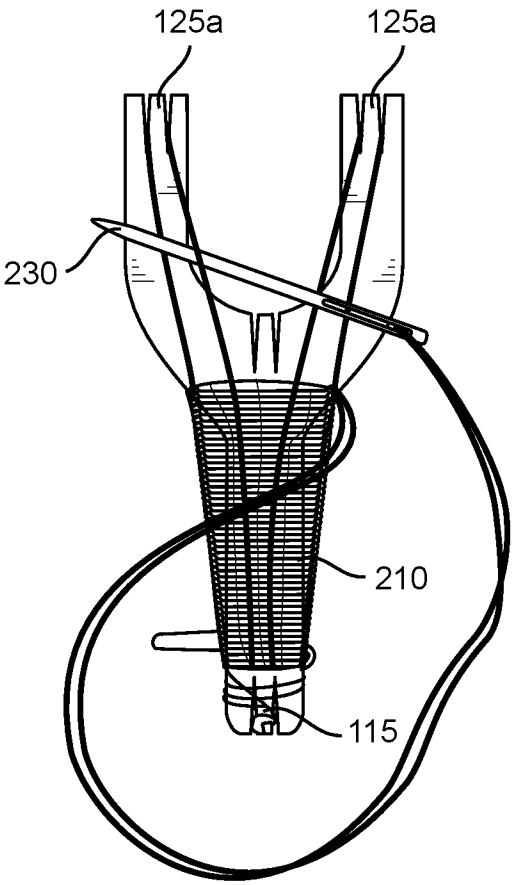
FIG. 6B is a perspective view of the craft tool of FIG. 1, shown in use making a weaving, in accordance with one embodiment of the invention.
Figure 6A:
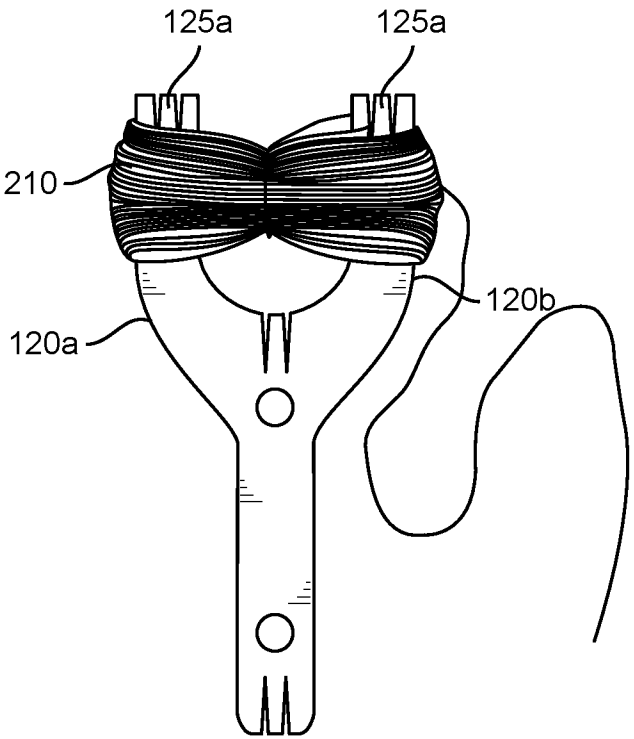
FIG. 6A is a perspective view of the craft tool of FIG. 1, shown in use making a pom-pom, in accordance with one embodiment of the invention.

FIGS. 6A-6F show the multi-purpose tool of the present invention in use creating various crafts. A user may manipulate the bottom portion 110 to utilize a range of fiber-based materials that can be woven, such as yarn, thread, floss, plastic, twine, twig, rope, filament, metal thread, so as to make variety of woven and fiber-based crafts including, but not limited to pom-poms, tassels, friendship bracelets, other bracelets, necklaces, various cords, and weavings. Depending on what the user is making, all parts of the tool 100 may not be used at the same time. For instance, for making pom-poms and tassels as shown in FIG. 6A, the first and second members 120*a* and 120*b*, and their notches 125*a* are used. In one method of using the tool, the fiber-based material, e.g., yarn 210, is first secured on one of the notches 125*a* and then wrapped or wound horizontally about the first and second members of the upper portion 120 and then tied in the middle.

Figure 6D:
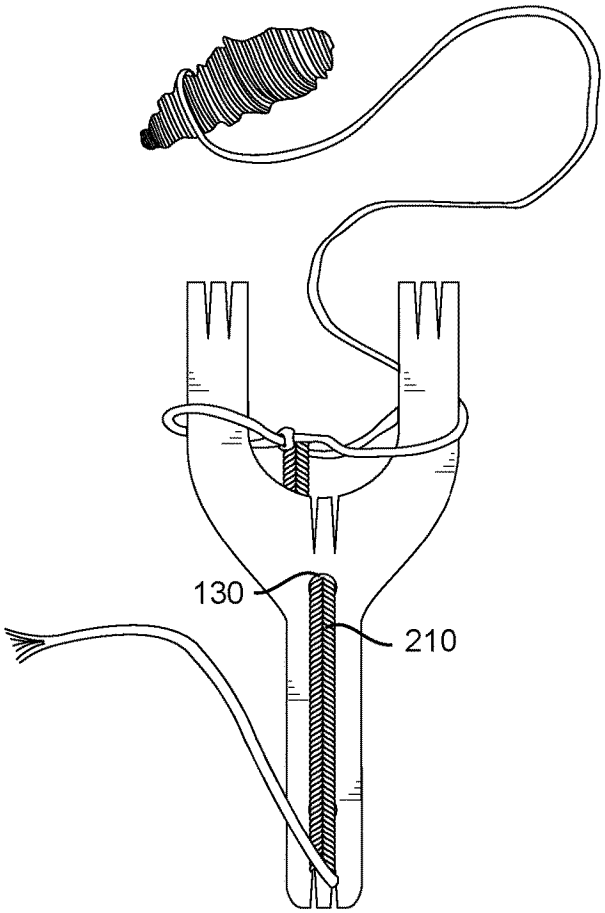
FIG. 6D is a perspective view of the craft tool of FIG. 1, shown in use making a braided cord, in accordance with one embodiment of the invention.
Figure 6C:
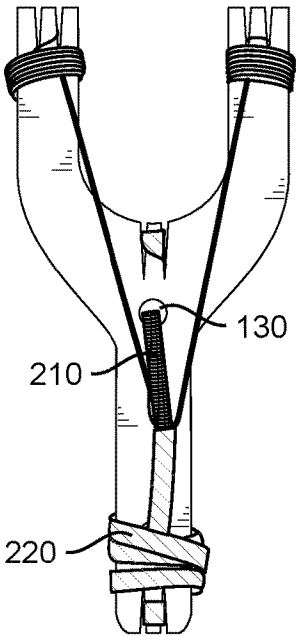
FIG. 6C is a perspective view of the craft tool of FIG. 1, shown in use making a bracelet, in accordance with one embodiment of the invention.

In another use shown in FIG. 6B, to make a weaving, the user first secures the yarn 210 in the notches 125*a* in the upper portion and notches 115 in the bottom portion to create a warp and then weaves through the tension of the previously secured yarn in the warp. The user may weave the yarn using his hands or use another object such as a needle 230. For creating the friendship bracelet, braids, and various cords as shown in FIG. 6C, FIG. 6D and FIG. 6E, the notches 115 in bottom portion and the notches 125*a* and 125*b* in the upper portion are used. The holes 130 may also be used. The yarn 210 is secured in a variety of configurations along the upper portion and/or bottom portion of the tool, based on the desired pattern and style of the craft. The user may use a second fiber-based material, yarn 220, in the weaving. Yarn 220 may be different than yarn 210 in color, texture, shape, pattern etc., so as to create an attractive bracelet or cord. The user may use one yarn or multiple yarns to create various interesting craft patterns. The bottom portion of the tool may also act as a handle and the upper portion of the tool may also act as one or more arms. The combination of the notches and the upper portion and/or the bottom portion allows the tool to serve multiple craft making purposes. The tool may be used to create linked craft items such as bracelets or non-linked craft items such as pom-poms. Further, the user may use one or more portions of the tool as needed to create the crafts. Using different embodiments of the tools further adds to the variety of crafts that may be made. The user may also incorporate beads, pearls etc. into the craft either at the time of weaving or afterwards to provide additional variety and pattern to the craft. Even with the same tool, the technique of placing and winding the yarn around the notches may vary and the notches themselves may be used to set up the tool in different orientations and provide almost endless possibilities of crafts and craft projects. The craft tool of the invention can thus be used by both kids and adults to create various crafts with ease.

Figure 6F:
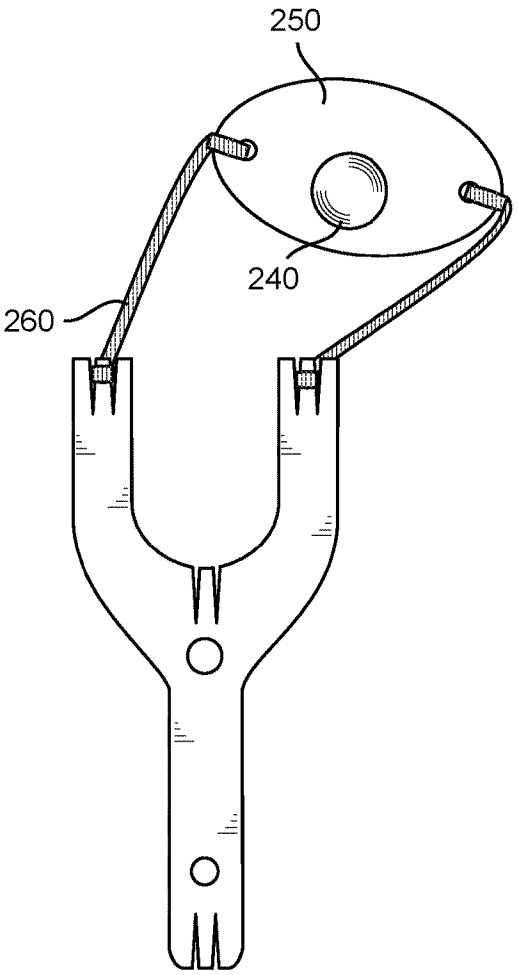
FIG. 6F is a perspective view of the craft tool of FIG. 1, shown in use as a sling shot, in accordance with one embodiment of the invention.
Figure 6E:
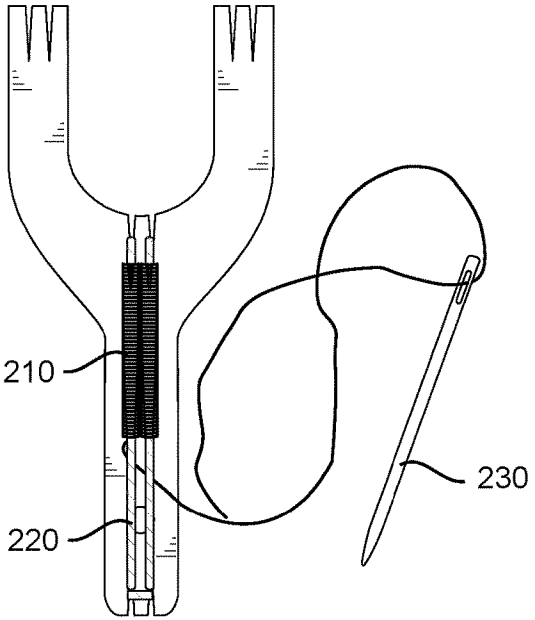
FIG. 6E is a perspective view of the craft tool of FIG. 1, shown in use making a another weave, in accordance with one embodiment of the invention.

In another embodiment shown in FIG. 6F, the user can use the craft-making tool 100 as a sling shot. Elastic bands 260 are secured to the notches 125*a* in the upper portion of the tool and attached with a small net 250. The net 250 acts as a sling shot to sling small objects such as a ball 240.

It is to be understood that the above-described embodiments are only illustrative of the application of the principles of the present invention. The illustrative discussions above are not intended to be exhaustive or to limit the invention to the precise forms disclosed. Various modifications and alternative applications may be devised by those skilled in the art in view of the above teachings and without departing from the spirit and scope of the present invention and the following claims are intended to cover such modifications, applications, and embodiments.

We claim:

1. A multi-purpose tool comprising:

(a) an upper portion, said upper portion comprising first and second upper members, the first and second upper members having a space in between and extending upwards and generally parallel to each other at ends of the first and second upper members;

(b) a bottom portion; said bottom portion comprising first and second bottom members, the first and second bottom members having a space in between and extending downwards and generally parallel to each other at ends of the first and second bottom members; and (c) a plurality of notches contained in each of the ends of the first and second bottom members and a plurality of notches contained in each of the ends of the first and second upper members;

(d) the upper portion being integrally formed with the bottom portion.

2. The multi-purpose tool of claim 1, further comprising one or more holes, the one or more holes contained in the bottom portion or a middle part of the tool.

3. The multi-purpose tool of claim 1, wherein (a) the first and second bottom members together form an inverted U-shape with a square groove;

(b) the first and second upper members together form a U-shape with a square groove; and (c) the bottom and upper portions together form a H-shape.

4. The multi-purpose tool of claim 3 further comprising one hole contained in a middle part of the tool.

5. The multi-purpose tool of claim 1 further comprising one hole contained in a middle part of the tool.

6. The multi-purpose tool of claim 1, wherein the tool is a monolithic body.

7. The multi-purpose tool of claim 1, wherein the upper portion is coupled to the bottom portion such that the upper portion cannot move relative to the bottom portion.

8. A method of using the multi-purpose tool of claim 1 for creating crafts, comprising:

(a) securing one end of a yarn to one of the plurality of notches contained in one of the ends of the first or second upper members;

(b) securing another part of the yarn to one of the plurality of notches contained in one of the ends of the first or second bottom members; and (c) weaving the yarn along any part of the upper portion or the bottom portion in any pattern for a plurality of times.

9. The method of claim 8, wherein the yarn is weaved through a tension of a previously woven yarn.

10. The method of claim 8, wherein the yarn is passed through one or more holes contained in the bottom portion or a middle part of the tool.

11. A method of using the multi-purpose tool of claim 1 for creating pom-poms and tassels, comprising:

(a) securing one end of a yarn to one of the plurality of notches contained in one of the ends of the first or second upper members;

(b) winding the yarn horizontally across and around the first and second upper members for a plurality of times; and (c) tying all of the wound yarn extending between the first and second upper members at any point across the wound yarn.

12. A multi-purpose tool comprising:

(a) a bottom portion having one bottom member extending downwards;

(b) an upper portion having first and second upper members, the first and second upper members having a space in between and extending upwards and generally parallel to each other at ends of the first and second upper members, the first and second upper members together form a U-shape with a square groove; and (c) a plurality of notches contained in an end of the bottom member and a plurality of notches contained in each of the ends of the first and second upper members;

(d) the bottom portion is wider than the space between the first and second upper members;

(e) the bottom and upper portions together form an inverted A-shape; and (f) the upper portion being integrally formed with the bottom portion.

13. The multi-purpose tool of claim 12 further comprising one hole contained in a middle part of the tool.

14. The multi-purpose tool of claim 12, wherein the tool is a monolithic body.

15. The multi-purpose tool of claim 12, wherein the upper portion is coupled to the bottom portion such that the upper portion cannot move relative to the bottom portion.

16. A method of using the multi-purpose tool of claim 12 for creating crafts, comprising:

(a) securing one end of a yarn to one of the plurality of notches contained in one of the ends of the first or second upper members;

(b) securing another part of the yarn to one of the plurality of notches contained in the one member of the bottom portion; and (c) weaving the yarn along any part of the upper portion or the bottom portion in any pattern for a plurality of times.

* * * * *